US006789770B2

(12) United States Patent
Schnedl

(10) Patent No.: US 6,789,770 B2
(45) Date of Patent: Sep. 14, 2004

(54) DEVICE FOR LOCKING THE END POSITIONS OF MOVING POINTS COMPONENTS

(75) Inventor: Karl Schnedl, Grosslobming (AT)

(73) Assignees: VAE GmbH, Vienna (AT); VAE Eisenbahnsysteme GmbH, Zeltweg (AT)

( * ) Notice: Subject to any disclaimer, the term of this patent is extended or adjusted under 35 U.S.C. 154(b) by 0 days.

(21) Appl. No.: 10/250,636

(22) PCT Filed: Jan. 11, 2002

(86) PCT No.: PCT/AT02/00008

§ 371 (c)(1),
(2), (4) Date: Jul. 3, 2003

(87) PCT Pub. No.: WO02/055361

PCT Pub. Date: Jul. 18, 2002

(65) Prior Publication Data

US 2004/0069911 A1 Apr. 15, 2004

(30) Foreign Application Priority Data

Jan. 11, 2001 (AT) ..... 39/2001

(51) Int. Cl.[7] ..... B61L 5/00
(52) U.S. Cl. ..... 246/448; 246/450
(58) Field of Search ..... 246/448, 450, 246/452, 443, 468; 188/67, 69, 68, 82.2

(56) References Cited

U.S. PATENT DOCUMENTS 5,566,912 A * 10/1996 Durchschlag ..... 246/448
6,354,541 B1 * 3/2002 Achleitner et al. ..... 246/448
6,666,412 B1 * 12/2003 Achleitner et al. ..... 246/450

FOREIGN PATENT DOCUMENTS

| | | | |
|---|---|---|---|
| AT | 403 683 B | 4/1998 | ..... B61L/5/00 |
| AT | 406 038 B | 1/2000 | ..... B61L/5/10 |
| EP | 0 603 156 A1 | 6/1994 | ..... B61L/5/10 |
| WO | WO 98/54041 | 12/1998 | ..... B61L/5/10 |
| WO | WO 99/30951 | 6/1999 | ..... B61L/5/10 |
| WO | WO 00/69697 | 11/2000 | ..... B61L/5/10 |

* cited by examiner

*Primary Examiner*—Mark T. Le
(74) *Attorney, Agent, or Firm*—Chapman and Cutler LLP

(57) ABSTRACT

The invention relates to a device for locking the end positions of movable switch parts and, in particular, the movable point (1) of a frog, in which two relatively axially displaceable parts are capable of being displaced into a position coupled with each other in a positive manner in at least one direction of movement, wherein the relatively displaceable parts are comprised of a tube (5) and a rod (6) guided within the tube (5) and are at least partially arranged in a stationary outer tube (4), whereby locking members (8) cooperate with the relatively axially displaceable parts (5, 6) as well as the outer tube (4) and are capable of being displaced in the radial direction into a locking position in a recess or inner annular groove (15, 16) of the outer tube (4). Said device is designed such that the outer tube (4) is comprised of two tube parts (17, 18) capable of being axially displaced within each other, and that each tube part carries at least one recess or inner annular groove (15, 16).

33 Claims, 3 Drawing Sheets

DEVICE FOR LOCKING THE END POSITIONS OF MOVING POINTS COMPONENTS

Figure 1:
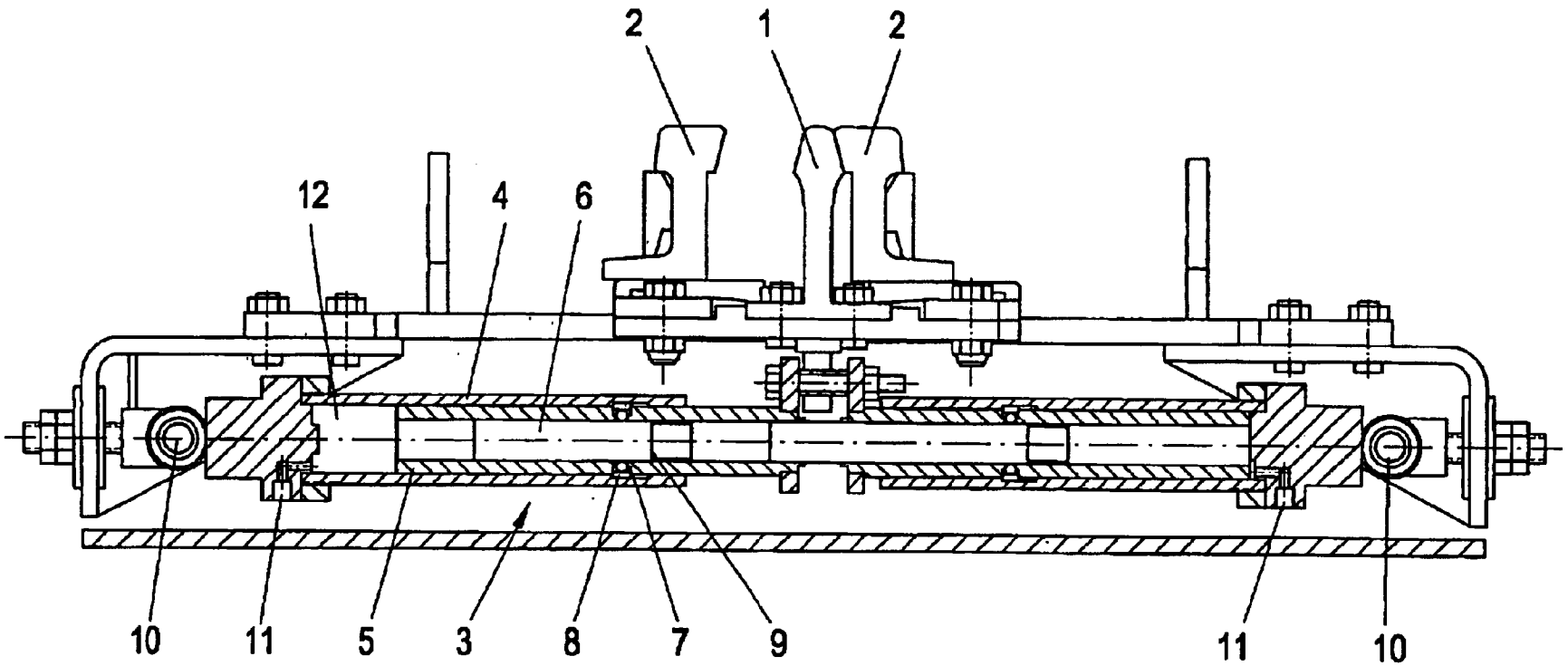

The invention relates to a device for locking the end positions of movable switch parts and, in particular, the movable point of a frog, in which two relatively axially displaceable parts are capable of being displaced into a position coupled with each other in a positive manner in at least one direction of movement, wherein the relatively displaceable parts are comprised of a tube and a rod guided within the tube and are at least partially arranged in a stationary outer tube, whereby locking members cooperate with the relatively axially displaceable parts as well as the outer tube and are capable of being displaced in the radial direction into a locking position in a recess or inner annular groove of the outer tube.

From EP-A 603 156 a device of the above-mentioned type has already become known, in which locking members comprised of balls are pressed into their locking positions by means of stops formed by thickened rod regions, thus abutting on a full-diameter partial region of the rod within a recess of the outer tube in the locking position. The balls pass through openings of the tubes surrounding the rod and each connected to a tongue, in a manner that a relative movement of this structural component connected with the tongue, namely the tube, relative to the outer tube will be effectively prevented as the balls are being pressed into their external positions, thus effecting locking between the outer tube and the tubular structural component. In order to undo said locking, the rod will have to be displaced, which may cause the ball to fall back onto reduced-diameter regions, thus emerging from the locking position within the groove of the outer tube.

According to a proposal known from WO 98/54041, the locking device known from EP 603 156 was improved to the effect that the balls are encompassed by an expandable ring or a ring comprised of segments. This measure aims to reduce the wear of the balls otherwise taking up the high locking forces via point contacts, since the accordingly high load can now be taken up by the annular segments or the expandable ring.

Furthermore, devices for shifting the positions and elastically locking the end positions of movable switch parts are also known, which are likewise referred to as switching aids. Such switching aids comprise an axially displaceable rod and a tube surrounding the rod, in which a spring surrounding the rod is braced against stops and radially outwardly displaceably locking members are arranged, the rod including, in an axially spaced-apart manner, control stops for the radially internal position of the locking members and the tube including stops for the external position of the locking members. Departing from such switching aids, it was proposed, for instance, in wo 00/69697 to fix at least one of the control stops to the rod in a manner displaceable in the axial direction of the rod. It is thereby feasible to adapt the displacement stroke of the adjustment device to the respective requirements. In particular, it is thereby safeguarded that the resilient application force at the tongue will enter into effect independently of a respectively adjustable active displacement path in order to enable the generation of constant application forces at the tongue irrespective of the displacement stroke.

All of the known devices are only suitable for the adjustment and locking of switch tongues, wherein a piston unit is arranged between the known locking devices, the piston rod of said piston unit being a component of the locking device. Both of the locking devices with the interposed hydraulic cylinder are coupled to the two tongues and serve to move and lock the closed and open positions, respectively, of the respective tongue. In order to adjust the movable point of a frog, it is, for instance, described in DE 2 002 025 how the movable frog is being connected to an existing, known switch lock using a clamp-like catch unit. To this end, the movable frog is being embraced on its lower side in the front nose region upon interposition of a slide piece which is coupled with the rod assembly of the switch lock using a clamp-like catch unit.

Unlike the adjustment of a tongue switch, the adjustment of a movable point of a frog calls for the observance of highly precise displacement paths, since in this case the adjustment is not effected between a closed and an open position, but both end positions of the displacement path constitute closed or abutment positions. Abutment in this case must be effected in a particularly precise manner, since it is usually required that a maximum gaping of the frog point in the abutment position of only 3 mm be admissible. The invention, therefore, aims to improve a device of the initially defined kind with a view to precisely adjusting the displacement stroke and enabling precise locking of the end position. The device is to be particularly suitable for the locking of an end position of the movable point of a frog and, at the same time, readily adaptable to the distance at which the locking device is coupled to the movable frog from the frog point, and hence the necessary displacement path.

To solve this object, the configuration according to the invention essentially consists in that the outer tube is comprised of two tube parts capable of being axially displaced within each other, and that each tube part carries at least one recess or inner annular groove. The arrangement of the recesses or inner annular groove engaged by the locking members in the displaced end position on two outer tube parts capable of being axially displaced within each other provides the prerequisite for the axial displacement of the locking grooves in order to thereby adjust the displacement stroke between the two end positions corresponding to the abutment position of the movable frog. Such an adjustment will be necessary, in particular, where one and the same locking device is coupled to the movable frog at different distances from the frog point. As a rule, one or several locking devices are arranged along a movable frog point with different displacement paths being each required. In order to standardize the mode of construction of the locking device, it is therefore necessary to use a uniform device in any locking plane with the only adjustment required being that of the respectively different stroke. This is now feasible in a simple manner by the configuration of the outer tube according to the invention, which is comprised of two tube parts capable of being axially displaced within each other. As a result, it is feasible to adjust the relative positions of the recesses or locking grooves arranged on the two tube parts according to the respective requirements already at the works-side assembly of the locking device.

In a preferred manner, the tube parts are each provided with a thread and capable of being screwed into each other, it being preferred that one tube part is designed as a stationary or rotationally fast inner tube and the other tube part is designed as an outer tube capable of being axially displaced by rotation and fixed in a rotary position. One of the tube parts can, thus, be displaced axially relative to the other tube part by simple rotation, extremely precise adjustment of the displacement stroke being feasible by transforming the rotary movement into an axial displacement of the tube part. To this end, the configuration in a preferred manner is further developed such that the axially displaceable outer tube comprises recesses for the engagement of a tool intended to rotate the axially displaceable outer tube.

For the operating safety of the locking device it is necessary that the respectively adjusted axial position of the two tube parts relative to each other and the thus adjusted displacement stroke can be fixed. To this end, the configuration in a preferred manner is devised such that the axially displaceable outer tube cooperates with a flange tube and is braceable between the flange tube and the stationary or rotationally fast inner tube, wherein, furthermore, the flange tube carries an internal thread and is capable of being screwed onto an external thread of the axially displaceable outer tube. This enables the two tube parts of the outer tube to be braced relative to each other in the axial direction, and hence prevented from being rotated. The axial bracing of the two tube parts offers the advantage of achieving an extremely compact mode of construction while, at the same time, rendering the arrangement of radially extending pins superfluous for the securement of the respective rotary position of the outer tube parts. The locking device is to constitute a compact and self-contained structural unit after the works-side adjustment of the respective displacement stroke, wherein it is particularly sought that no parts readily accessible from outside be provided, which would enable an alteration of the displacement stroke adjusted by the manufacturer. In a preferred manner, the configuration is devised such that at least one screw connection is provided for the fixation of the rotary position.

In order to ensure the respective axial displaceability of the two tube parts of the outer tube, a clear cross section between the outer circumference of the tube and the inner circumference of the axially displaceable outer tube cannot be prevented. In order to safeguard the engagement of the locking members not in this clear cross section, but only in the locking grooves provided therefor, the configuration advantageously is further developed such that adjustable cheek bridges or a spacer sleeve are arranged in the clear cross section between the outer circumference of the tube and the inner circumference of the axially displaceable outer tube. The use of cheek bridges has the advantage of enabling the continuous adjustment of the displacement stroke, whereas the use of spacer sleeves merely allows for stepwise adjustment.

While, during the displacement movement of the movable frog, the forces to be taken up by a locking ball are limited by the maximally admissible displacement force, the balls usually can be stressed by a multiple in the locking position. Since such locking forces can be taken up by balls merely by point contacts, the contact points are exposed to very high loads, which may lead to inadmissible deformations. In order to ensure also the absorption of extremely high locking forces without entailing the risk of a premature functional impairment of the lock, the configuration preferably is further developed in a manner that the locking members are formed by balls which are encompassed by an expandable ring or a ring comprised of segments, that the segments or the ring, respectively, are/is resiliently held in a position with an outer diameter smaller than, or equal to, the outer diameter of the axially displaceable tube guided within the outer tube, and reach(es) into a peripheral groove of the tube, and that the balls are arranged in tube holes provided between the rod and the ring comprised of segments.

Figure 2:
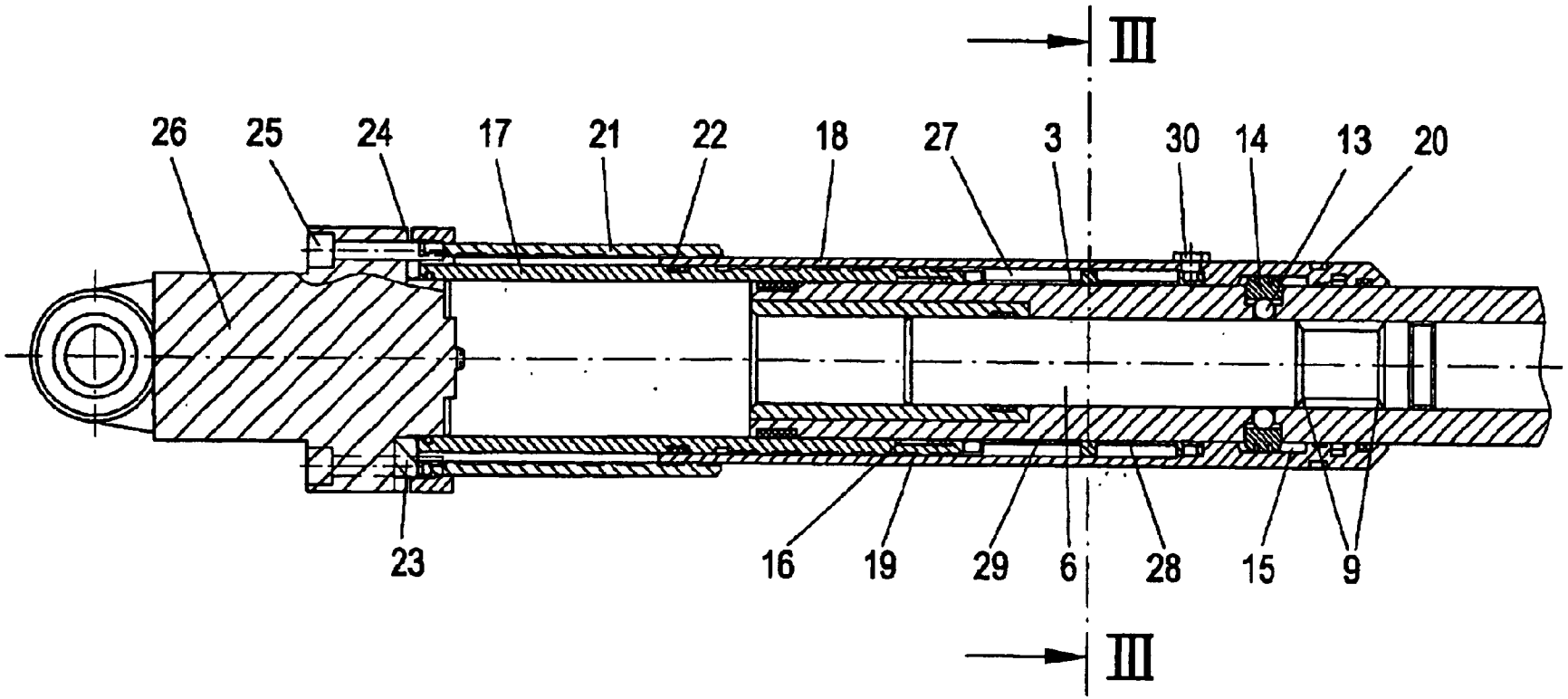
Figure 3:
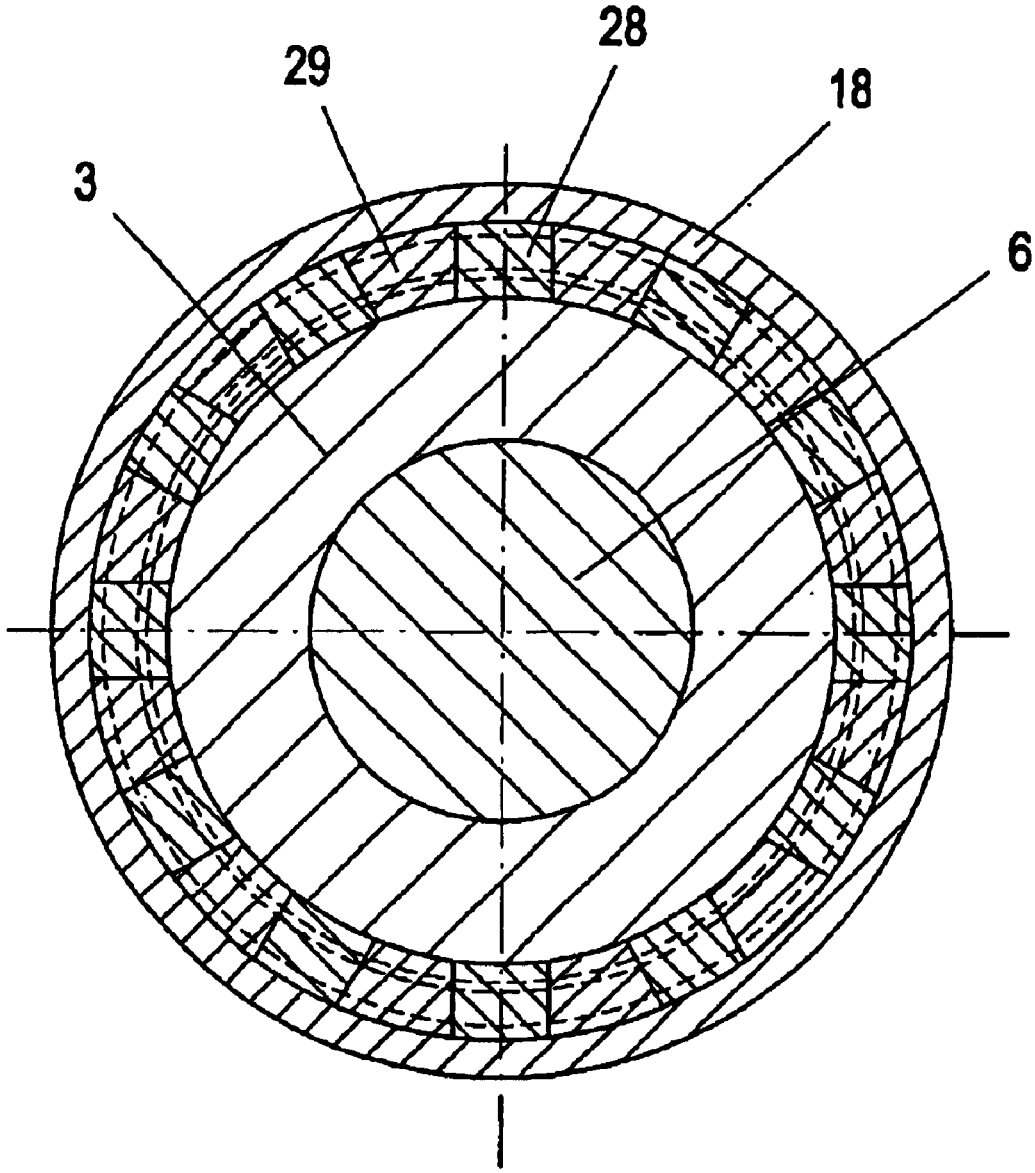

In the following, the invention will be explained in more detail by way of exemplary embodiments schematically illustrated in the drawing. Therein, FIG. 1 illustrates a conventional locking device with an invariable displacement course;

FIG. 2 is a partial view of the locking device according to the invention with a variable displacement course; and FIG. 3 is a section along line III—III of FIG. 2.

FIG. 1 depicts a movable frog 1, which is to be facultatively displaced into abutment on two guardrails 2 and locked in the respective abutment position. The device for adjusting the position of the frog 1 and locking the respective end position is denoted by 3 and comprises an outer tube 4, an inner tube 5 guided within said outer tube, and a rod 6. The internally arranged tube 5 includes openings 7 for the reception of locking or coupling members 8, the inwardly located rod 6 having appropriate stop shoulders 9 for coupling with said coupling and locking members 8. The device 3 is stationarily fixed to the ends schematically indicated by 10. In addition, a hydraulic connection 11 running into a working volume 12 is apparent, the respective connections being symmetrically provided in the representation according to FIG. 1.

In the illustration according to FIG. 1, the frog 1 is displaced in its right-side end position, wherein the locking members 8 engage in respective locking grooves of the externally arranged tube 4 by running onto the respective full cross section of the rod 6, thus causing the internally arranged tube 5 to be secured against further displacement and the frog 1 to be safely held in the abutment position. This corresponds to the position illustrated in FIG. 2 on an enlarged scale, from which it is also apparent that the coupling and locking members are formed by internally arranged balls 13 and ring segments 14 overlapping the balls so as to enable the surface contact of the ring segments with the flank of the groove 15 in the locking position. The locking groove 15 in this case corresponds to the right-hand end position of the movable frog shown in FIG. 1, wherein a further locking groove 16 is, moreover, provided to lock the abutment position on the left side. As is apparent from FIG. 2, the outer tube 4 is comprised of two tube parts, one tube part 17 being designed as a stationary or rotationally fast inner tube and the other tube part 18 being designed as an outer tube capable of being axially displaced by rotation. The respective thread by which the two tube parts 17 and 18 can be screwed one into the other is denoted by 19. The tube part 18 carries the locking groove 15 for the right-side abutment and the tube part 17 carries the locking groove 16 for the left-side abutment. In order to vary the axial distance between the locking grooves 15 and 16, and hence the displacement stroke of the locking device, the tube part 18 is displaced by engagement of an appropriate tool in the recesses 20 and rotation in the axial direction.

FIG. 2, furthermore, depicts a flange tube 21, which is connected with the tube part 18 via a thread 22. In order to prevent the flange tube 21 as well as the inner tube 17 from rotating during the adjustment procedure, the flange tube 21 and the inner tube 17 are secured against rotation by a torque-supporting element 23. After the necessary distance between the two locking grooves 15 and 16 has been adjusted, the flange tube 21 as well as the tube part 18 can be braced against the tube part 17 by means of the turning screw 25. In doing so, the tube part 17 bears against an end face 24 of the articulated head 26 so as to form a rigid unit of the tube parts 17 and 18.

As is apparent from FIG. 2, a free space 27 is present between the tube part 18 and the inner tube 3, which free space, according to the invention, is covered by adjustable cheek bridges 28 and 29. The cheek bridges 28 and 29 are slidably movable within each other with their axial entrainment being safeguarded by the screw 30. As is more readily apparent from FIG. 3, the cheek bridges 28 and 29 are formed with mutually engaging fingers-so as to be able to slide within each other in the axial direction. This ensures the complete coverage of the clear cross section 27 even at a continuous adjustment of the displacement stroke of the locking device.

What is claimed is:

1. A device for locking end positions of movable switch parts and, in particular, a movable point (1) of a frog, comprising two relatively axially displaceable parts capable of being displaced into a position coupled with each other in a positive manner in at least one direction of movement, wherein the relatively axially displaceable parts are comprised of a tube (5) and a rod (6) guided within the tube (5), and are at least partially arranged in a stationary outer tube (4), whereby locking members (8) cooperate with the relatively axially displaceable parts (5, 6) and with the stationary outer tube (4), and said locking members (8) are capable of being displaced in the radial direction into a locking position in a recess or inner annular groove (15, 16) of the stationary outer tube (4), and wherein the stationary outer tube (4) is comprised of two tube parts, wherein the first of said two tube parts is an axially displaceable inner tube part (17) capable of being axially displaced within the second tube part which is an axially displaceable outer tube part (18), and each of said two axially displaceable tube parts (17,18) has at least one recess or inner annular groove (15, 16).

2. A device according to claim 1, wherein the two axially displaceable tube parts (17, 18) are each provided with a thread (19) and are capable of being screwed into each other.

3. A device according to claim 1, wherein the axially displaceable inner tube part (17) is stationary or rotationally fast, and the axially displaceable outer tube part (18) is capable of being axially displaced by rotation and fixed in a rotary position.

4. A device according to claim 2, wherein the axially displaceable inner tube part (17) is stationary or rotationally fast, and the axially displaceable outer tube part (18) is capable of being axially displaced by rotation and fixed in a rotary position.

5. A device according to claim 1, wherein the axially displaceable outer tube part (18) comprises recesses (20) for engagement of a tool for rotating the axially displaceable outer tube part (18).

6. A device according to claim 2, wherein the axially displaceable outer tube part (18) comprises recesses (20) for engagement of a tool for rotating the axially displaceable outer tube part (18).

7. A device according to claim 3, wherein the axially displaceable outer tube part (18) comprises recesses (20) for engagement of a tool for rotating the axially displaceable outer tube part (18).

8. A device according to claim 1, wherein the axially displaceable outer tube part (18) cooperates with a flange tube (21) and is braceable between the flange tube (21) and the axially displaceable inner tube part (17).

9. A device according to claim 2, wherein the axially displaceable outer tube part (18) cooperates with a flange tube (21) and is braceable between the flange tube (21) and the axially displaceable inner tube part (17).

10. A device according to claim 3, wherein the axially displaceable outer tube part (18) cooperates with a flange tube (21) and is braceable between the flange tube (21) and the axially displaceable inner tube part (17).

11. A device according to claim 5, wherein the axially displaceable outer tube part (18) cooperates with a flange tube (21) and is braceable between the flange tube (21) and the axially displaceable inner tube part (17).

12. A device according to claim 8, wherein the flange tube (21) has an internal thread (22) and is capable of being screwed onto an external thread of the axially displaceable outer tube part (18).

13. A device according to claim 9, wherein the flange tube (21) has an internal thread (22) and is capable of being screwed onto an external thread of the axially displaceable outer tube part (18).

14. A device according to claim 10, wherein the flange tube (21) has an internal thread (22) and is capable of being screwed onto an external thread of the axially displaceable outer tube part (18).

15. A device according to claim 11, wherein the flange tube (21) has an internal thread (22) and is capable of being screwed onto an external thread of the axially displaceable outer tube part (18).

16. A device according to claim 3, further comprising at least one screw connection (25) for fixation of the rotary position.

17. A device according to claim 7, further comprising at least one screw connection (25) for fixation of the rotary position.

18. A device according to claim 10, further comprising at least one screw connection (25) for fixation of the rotary position.

19. A device according to claim 1, wherein adjustable cheek bridges (28, 29) are arranged in a clear cross section between an outer circumference of the tube (5) and an inner circumference of the axially displaceable outer tube part (18).

20. A device according to claim 2, wherein adjustable cheek bridges (28, 29) are arranged in a clear cross section between an outer circumference of the tube (5) and an inner circumference of the axially displaceable outer tube part (18).

21. A device according to claim 3, wherein adjustable cheek bridges (28, 29) are arranged in a clear cross section between an outer circumference of the tube (5) and an inner circumference of the axially displaceable outer tube part (18).

22. A device according to claim 5, wherein adjustable cheek bridges (28, 29) are arranged in a clear cross section between an outer circumference of the tube (5) and an inner circumference of the axially displaceable outer tube part (18).

23. A device according to claim 1, wherein a spacer sleeve is arranged in a clear cross section between an outer circumference of the tube (5) and an inner circumference of the axially displaceable outer tube part (18).

24. A device according to claim 2, wherein a spacer sleeve is arranged in a clear cross section between an outer circumference of the tube (5) and an inner circumference of the axially displaceable outer tube part (18).

25. A device according to claim 3, wherein a spacer sleeve is arranged in a clear cross section between an outer circumference of the tube (5) and an inner circumference of the axially displaceable outer tube part (18).

26. A device according to claim 5, wherein a spacer sleeve is arranged in a clear cross section between an outer circumference of the tube (5) and an inner circumference of the axially displaceable outer tube part (18).

27. A device according to claim 1, wherein the locking members (8) are formed by balls (13) which are encompassed by an expandable ring (14), wherein the ring (14) is resiliently held in a position with an outer diameter smaller than, or equal to, an outer diameter of the tube (5) within the outer tube (4), and reaches into a peripheral groove (15, 16) of the outer tube (4), and wherein the balls (13) are arranged in tube holes (7) provided between the rod (6) and the ring (14).

28. A device according to claim 2, wherein the locking members (8) are formed by balls (13) which are encompassed by an expandable ring (14), wherein the ring (14) is resiliently held in a position with an outer diameter smaller than, or equal to, an outer diameter of the tube (5) within the outer tube (4), and reaches into a peripheral groove (15, 16) of the outer tube (4), and wherein the balls (13) are arranged in tube holes (7) provided between the rod (6) and the ring (14).

29. A device according to claim 3, wherein the locking members (8) are formed by balls (13) which are encompassed by an expandable ring (14), wherein the ring (14) is resiliently held in a position with an outer diameter smaller than, or equal to, an outer diameter of the tube (5) within the outer tube (4), and reaches into a peripheral groove (15, 16) of the outer tube (4), and wherein the balls (13) are arranged in tube holes (7) provided between the rod (6) and the ring (14).

30. A device according to claim 5, wherein the locking members (8) are formed by balls (13) which are encompassed by an expandable ring (14), wherein the ring (14) is resiliently held in a position with an outer diameter smaller than, or equal to, an outer diameter of the tube (5) within the outer tube (4), and reaches into a peripheral groove (15, 16) of the outer tube (4), and wherein the balls (13) are arranged in tube holes (7) provided between the rod (6) and the ring (14).

31. A device according to claim 27, wherein the expandable ring (14) is comprised of segments, and wherein the segments of the ring (14) are resiliently held in a position with an outer diameter smaller than, or equal to, an outer diameter of the tube (5) within the outer tube (4), and reach into a peripheral groove (15, 16) of the outer tube (4), and wherein the balls (13) are arranged in tube holes (7) provided between the rod (6) and the ring (14).

32. A device according to claim 28, wherein the expandable ring (14) is comprised of segments, and wherein the segments of the ring (14) are resiliently held in a position with an outer diameter smaller than, or equal to, an outer diameter of the tube (5) within the outer tube (4), and reach into a peripheral groove (15, 16) of the Outer tube (4), and wherein the balls (13) are arranged in tube holes (7) provided between the rod (6) and the ring (14).

33. A device according to claim 29, wherein the expandable ring (14) is comprised of segments, and wherein the segments of the ring (14) are resiliently held in a position with an outer diameter smaller than, or equal to, an outer diameter of the tube (5) within the outer tube (4), and reach into a peripheral groove (15, 16) of the outer tube (4), and wherein the balls (13) are arranged in tube holes (7) provided between the rod (6) and the ring (14).

* * * * *